US006155478A

United States Patent [19]

Yang

[11] Patent Number: 6,155,478

[45] Date of Patent: Dec. 5, 2000

[54] PAPER CUP WITH SIPPING STRAW FORMED THEREON

[76] Inventor: Bong Chul Yang, 105-1105 Woosung IV Apts., Jamsilbon-dong, Songpa-ku Seoul, Rep. of Korea

[21] Appl. No.: 09/480,367

[22] Filed: Jan. 10, 2000

[51] Int. Cl.[7] ..... B65D 3/28

[52] U.S. Cl. ..... 229/103.1; 229/400

[58] Field of Search ..... 229/103.1, 400; 215/389; 220/705, 710

[56] References Cited

U.S. PATENT DOCUMENTS

| | | | |
|---|---|---|---|
| 1,213,961 | 1/1917 | Shepard | 229/400 |
| 2,487,100 | 11/1949 | Cohen | 229/400 |
| 2,599,919 | 6/1952 | Hucknall | 220/710 |
| 2,838,220 | 6/1958 | Oppenheimer et al. | 229/103.1 |
| 3,921,889 | 11/1975 | Gibbons | 220/710 |
| 5,423,473 | 6/1995 | Ferrer | 229/103.1 |
| 5,495,982 | 3/1996 | Wang | 229/103.1 |
| 6,019,277 | 2/2000 | Lundstrom | 229/103.1 |

*Primary Examiner*—Gary E. Elkins
*Attorney, Agent, or Firm*—Warner Norcross & Judd

[57] ABSTRACT

A paper cup with a sipping straw integrally formed thereon is disclosed. The paper cup with a sipping straw integrally formed thereon is manufactured either by attaching a separate paper member (11), or by forming an expanded portion (21). The sipping straw (17) or (27) is provided with a slot (16) or (26), and folding lines. An upper portion (37) of the sipping straw is folded down to be attached onto a side of the paper cup during a non-use, and is straightened up during a use. Further, wrinkles are formed on the upper portion of the sipping straw, so that the sipping straw can be properly bent during a use for the sake of convenience.

5 Claims, 13 Drawing Sheets

PAPER CUP WITH SIPPING STRAW FORMED THEREON

FIELD OF THE INVENTION

The present invention relates to a paper cup with a sipping straw integrally formed thereon.

BACKGROUND OF THE INVENTION

Conventionally, paper cups and sipping straws are separately manufactured, and separately sold. Therefore, the auxiliary expenses are high, and the handling and the use are inconvenient. That is, the paper cup and the sipping straws are manufactured by different manufacturing companies, and therefore, grocery stores have to procure them from different manufacturing companies. Therefore, there are many kinds of difficulties in procuring, transporting and storing them.

Further, the sipping straws are made of a synthetic resin, and therefore, after the use of them, the paper cups and the sipping straws have to be recycled through different routes, this also being troublesome.

SUMMARY OF THE INVENTION

The present invention is intended to overcome the above described disadvantages of the conventional technique.

Therefore it is an object of the present invention to provide a paper cup in which a sipping straw is integrally formed.

In achieving the above object, the paper cup with a sipping straw formed thereon according to the present invention is characterized in that a sipping straw is formed within the paper cup, and the sipping straw is formed either by attaching a separate piece of paper to the paper cup, or an expanded portion is provided on the paper cup so as to form the sipping straw.

Further, on the portion of the sipping straw, there are formed a plurality of folding lines. When the sipping straw is not used, the sipping straw lies in a collapsed state, but when the sipping straw is to be used, if a pressure is applied on the portion of the sipping straw, then the portion is expanded to form a real sipping straw.

Further, the upper portion of the sipping straw, i.e., the portion of the sipping straw above the paper cup is folded down to be attached on the side of the paper cup when the sipping straw is not used. However, when the sipping straw is to be used, the mentioned portion of the sipping straw is straightened up, so that a real sipping straw would be formed.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENTS

Figure 1:
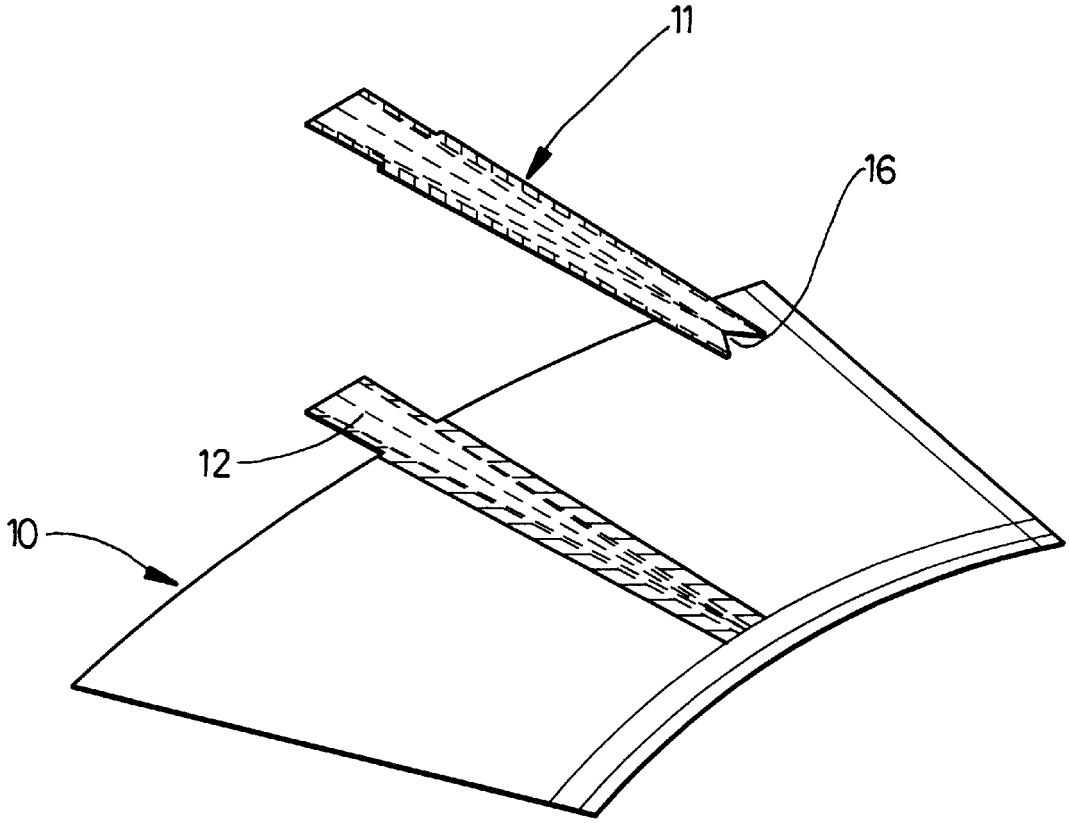
FIG. 1 is an unfolded perspective view of a first embodiment of the device according to the present invention.
Figure 2A:
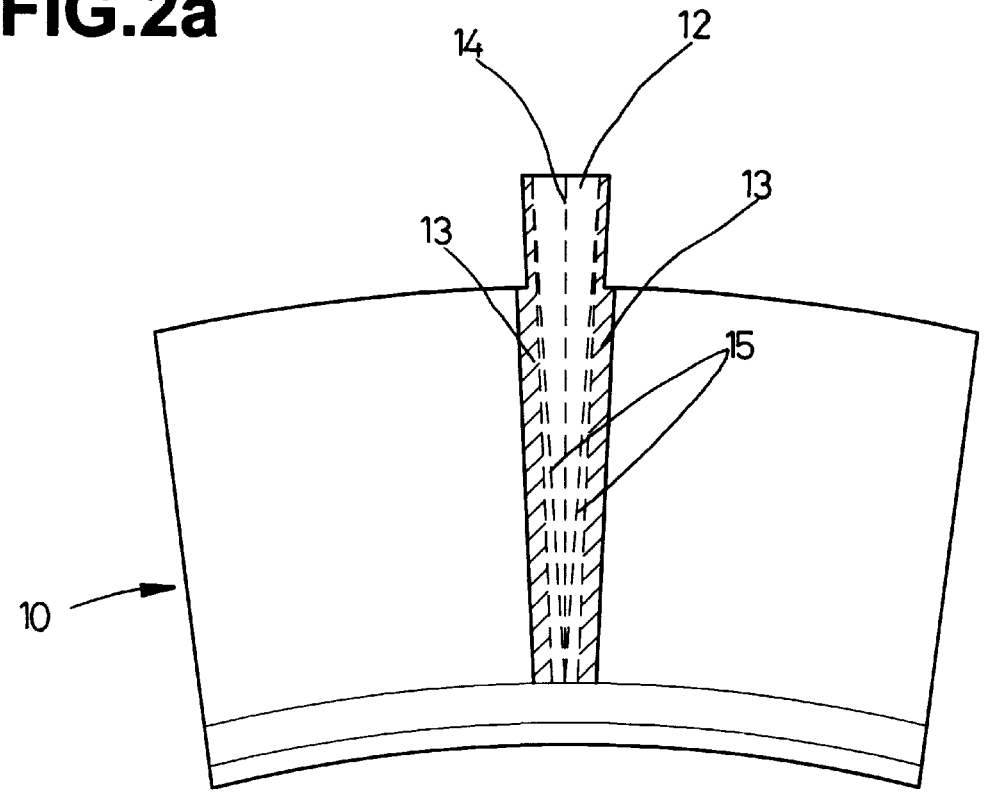
FIGS. 2*a* and 2*b* are detailed illustrations of the device of FIG. 1.
Figure 2B:
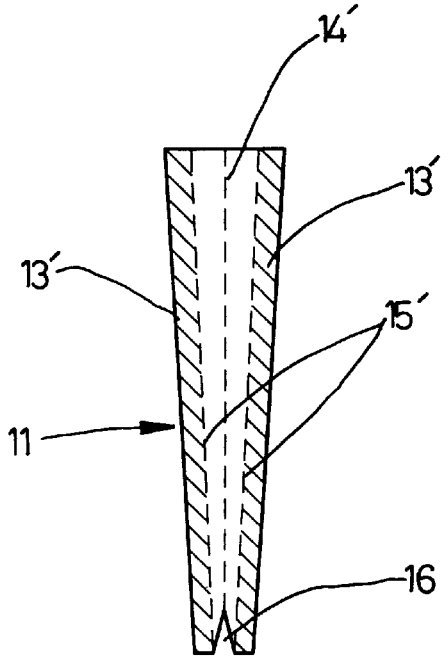
Figure 3:
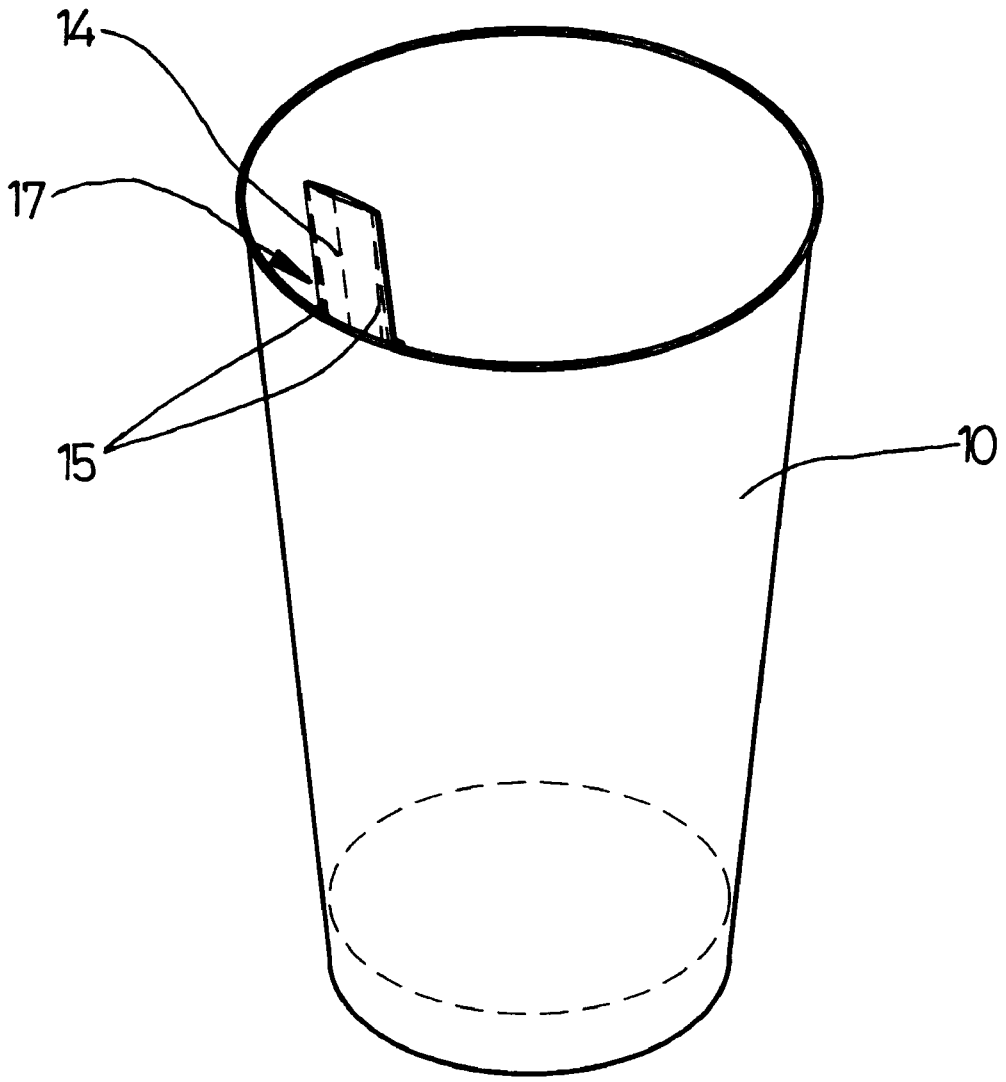
FIG. 3 illustrates a coupled state of the first embodiment of the device according to the present invention.

FIG. 1 is an unfolded perspective view of a first embodiment of the device according to the present invention. Here, a separate paper member is added to form the sipping straw. FIGS. 2*a* and 2*b* are detailed illustrations of the device of FIG. 1.

A paper stock is sheared in such a manner that a paper cup body 10 and a projected portion 12 can be formed. The projected portion 12 will form a part of the walls of the sipping straw later. Then a separate paper member 11 is attached to the corresponding portion, in such a manner that the paper member 11 will form another part of the walls of the sipping straw.

In FIG. 2, the shaded areas 13 and 13' are the portions on which an adhesive will be spread.

Folding lines 14 and 15 are formed on the projected portion 12 down to the lower end of the paper cup body 10. Further, folding lines 14' and 15' are formed on the paper member 11.

At the lower end of the paper member 11, there is formed a slot 16 through which the content of the paper cup will be introduced into the sipping straw when a user sips.

After forming the sipping straw in the above described manner, the both side edges of the paper cup body 10 are bonded together, and a bottom member is attached. Thus the paper cup of the present invention is completed.

Figure 4:
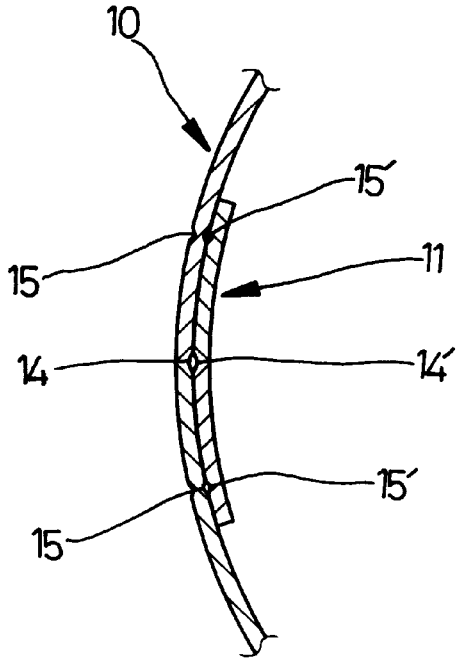
FIG. 4 is a sectional view showing the coupling of the paper member to the body of the paper cup.
Figure 5:
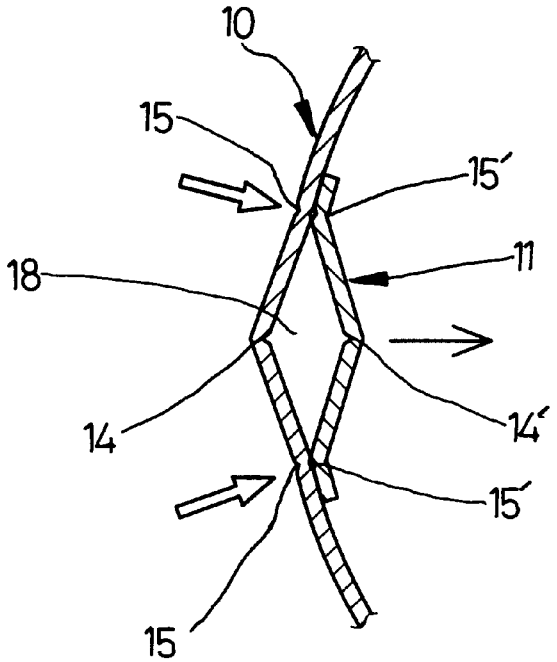
FIG. 5 is a sectional view showing the sipping straw formation procedure.
Figure 6:
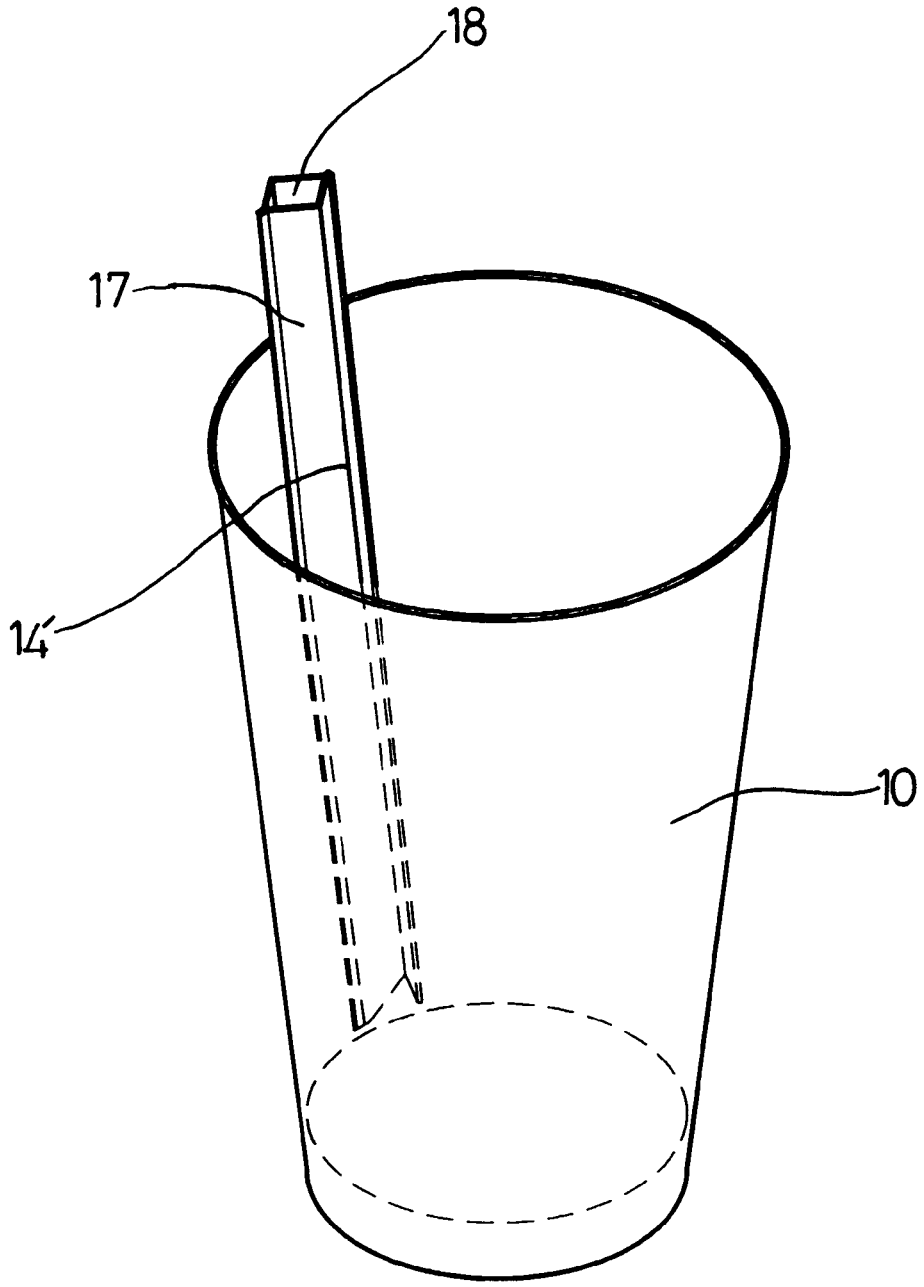
FIG. 6 is a perspective view showing the finished first embodiment of the paper cup with the sipping straw formed thereon according to the present invention.

FIG. 4 is a sectional view showing the coupling of the paper member 11 to the paper cup body 10. As shown in this drawing, when the sipping straw is not used, the paper member 11 is collapsed to the paper cup body 10. However, when the sipping straw is to be used, if a pressure is applied in the direction of the arrow mark, then the paper member 11 is expanded inward by the help of the folding lines 14 and 14' and the folding lines 15, 15, 15' and 15' as shown in FIG. 5. Thus a conduit 18 is formed in the lengthwise direction of the sipping straw, resulting in that a sipping straw 17 is formed as shown in FIG. 6.

FIGS. 7 to 12 illustrate another embodiment of the device of the present invention, in which without using the paper member 11, an expanded portion 21 is provided on the paper cup body 20 so as to form a sipping straw.

Figure 7:
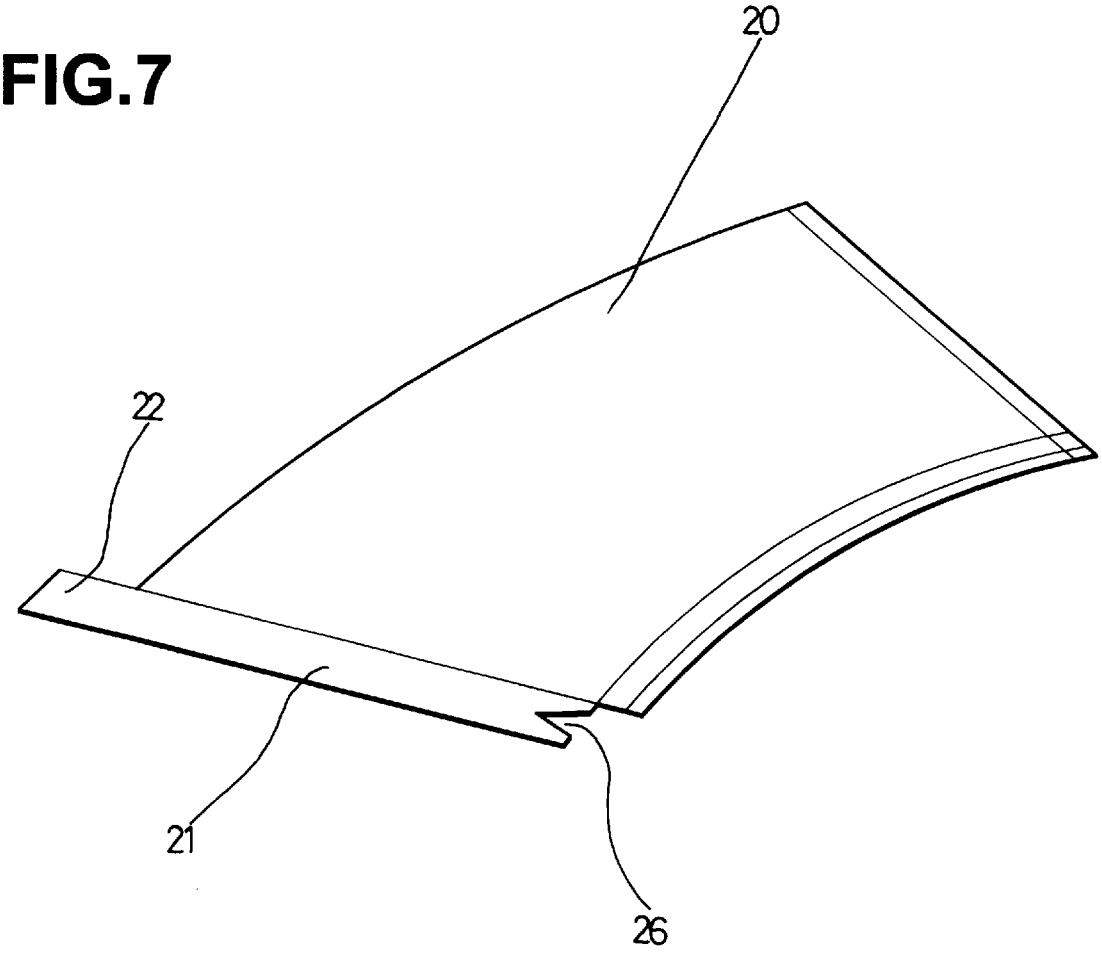
FIG. 7 is an unfolded perspective view of a second embodiment of the device according to the present invention.

As shown in FIG. 7, the expanded portion 21 is formed on a side edge of the paper cup body 20, and the expanded portion 21 is provided with a projected portion 22 and a slot 26. The projected portion 22 will be formed into an upper portion of the sipping straw, while the slot 26 will introduce the content of the paper cup when the user sips.

Figure 8:
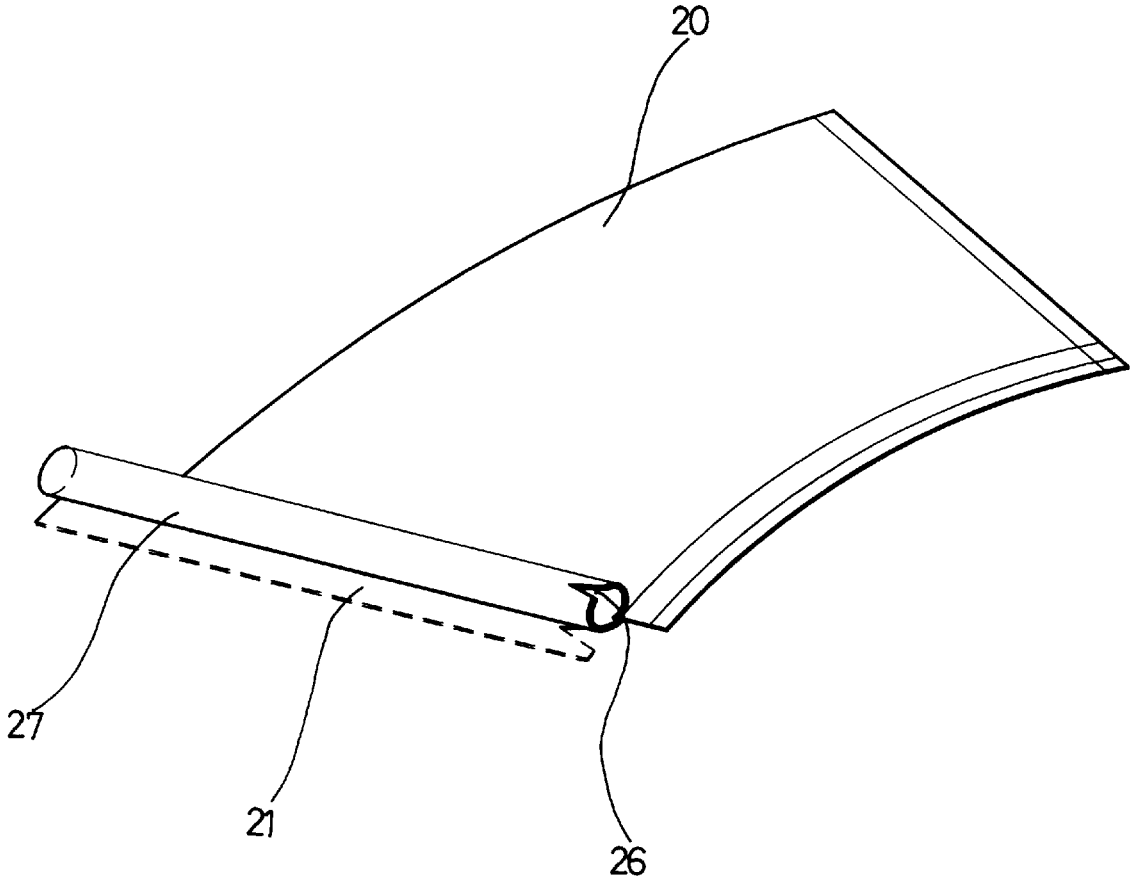
FIG. 8 is an unfolded perspective view of the second embodiment of the device, showing the sipping straw formation process.
Figure 9:
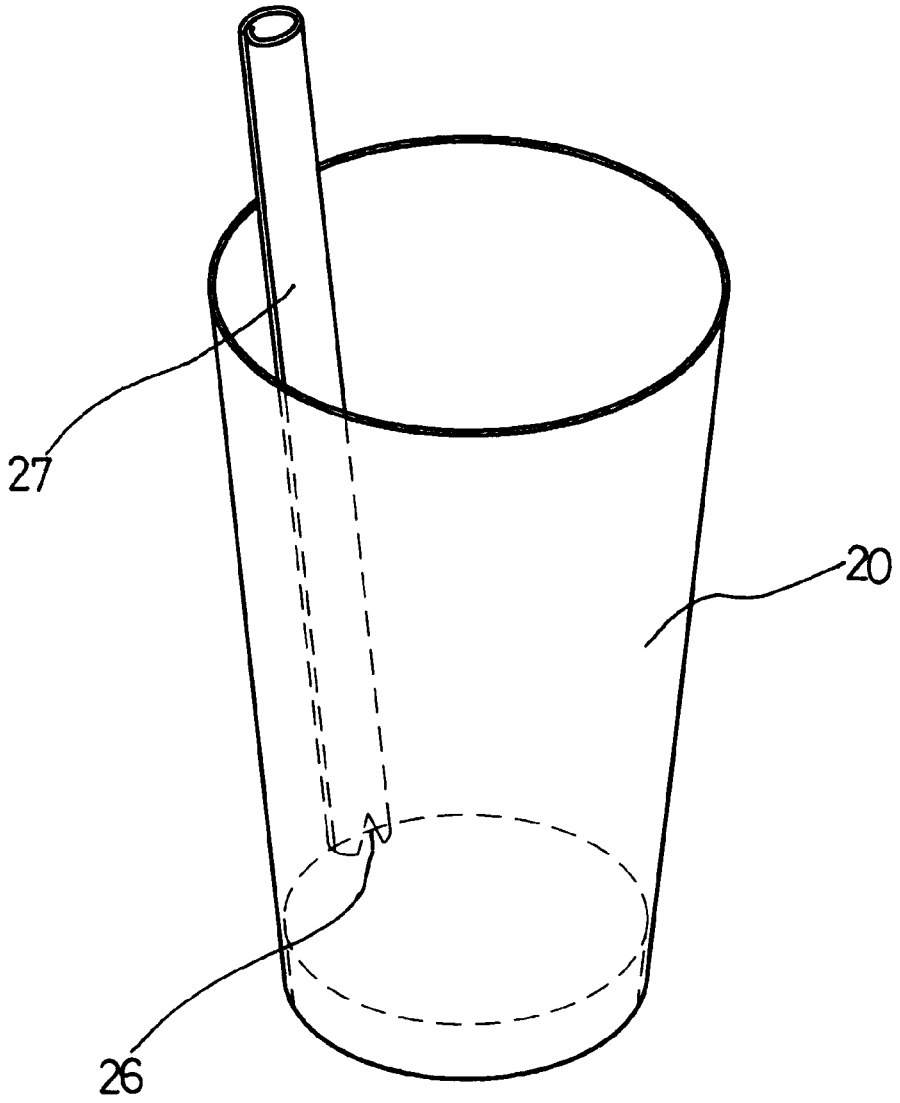
FIG. 9 is a perspective view showing the finished second embodiment of the paper cup with the sipping straw formed thereon according to the present invention.

As shown in FIG. 8, the expanded portion 21 is rolled into a circular pipe to form a sipping straw 27. Then the sipping straw thus formed is bonded to the other side edge of the paper cup body 20, thereby completing the second embodiment of the device of the present invention as shown in FIG. 9.

Figure 10:
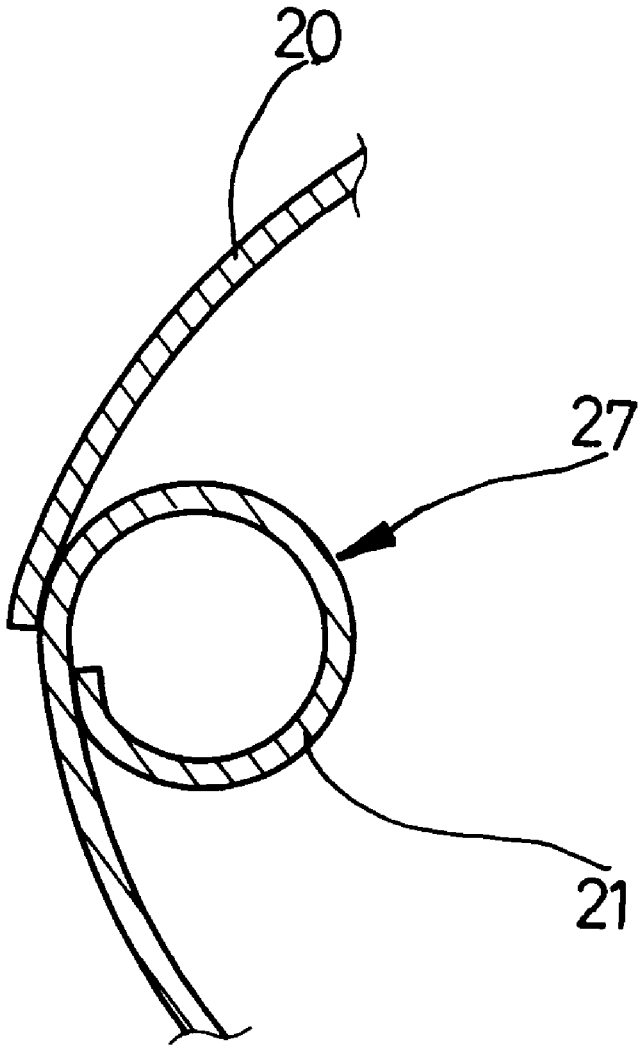
FIG. 10 is a sectional view showing the constitution of the sipping straw.

FIG. 10 is a sectional view showing the constitution of the sipping straw 27 which is formed on the paper cup body 20.

Figure 11:
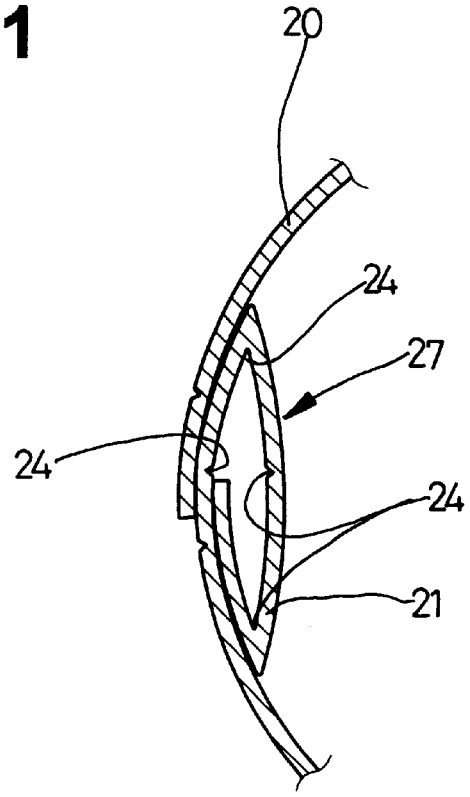
FIG. 11 is a sectional view showing a state in which the sipping straw is partly collapsed.
Figure 12:
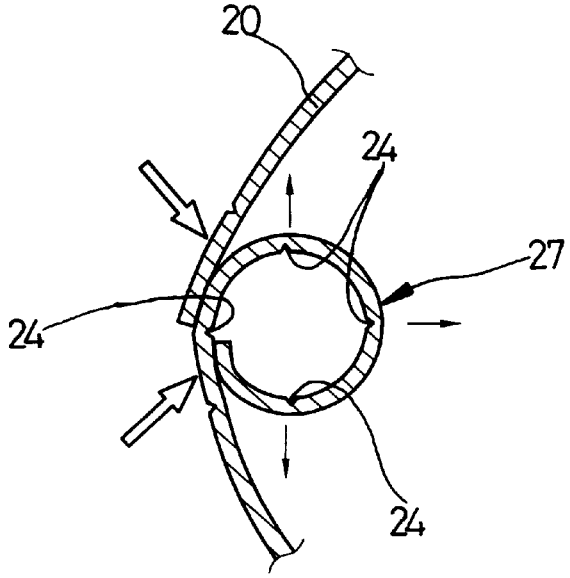
FIG. 12 illustrates a state in which the sipping straw is expanded to a usable state.

In this embodiment also, folding lines 24 can be provided on the inside of the sipping straw in the lengthwise direction thereof, so that during the non-use of the sipping straw, the sipping straw can be collapsed as shown in FIG. 11. When the sipping straw is to be used, the sipping straw can be made expanded by applying a pressure in the direction of the arrow mark as shown in FIG. 12.

Figure 13:
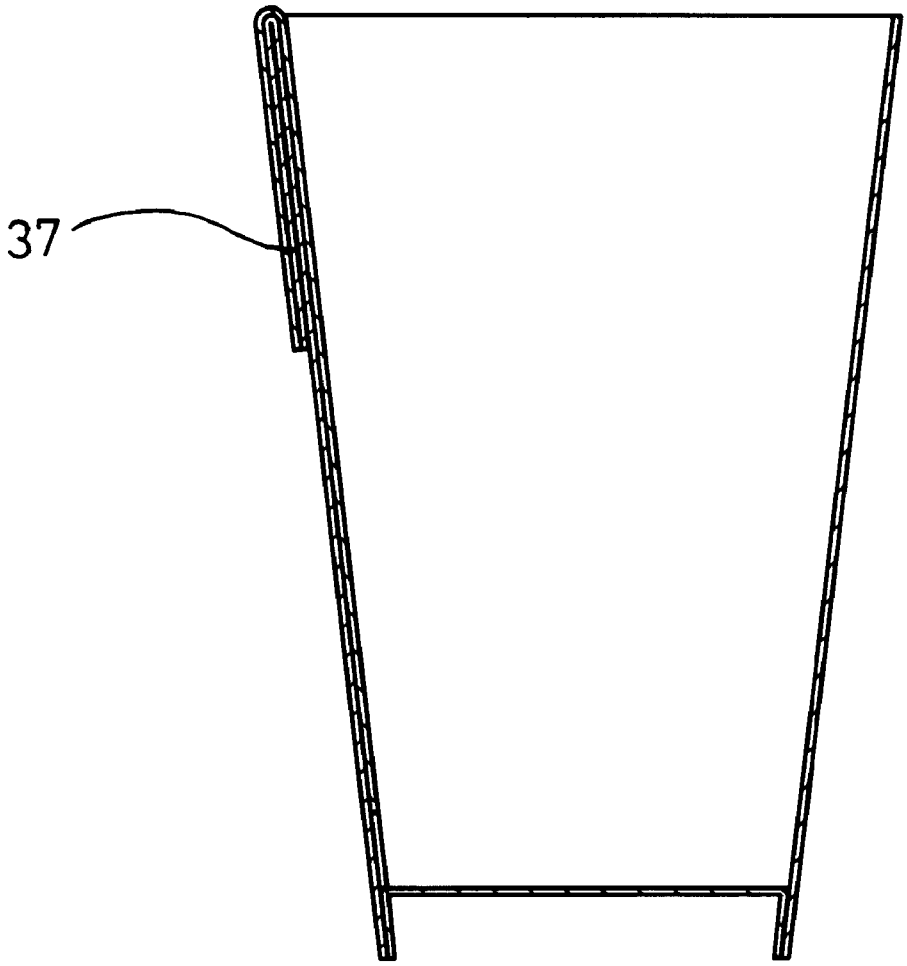
FIG. 13 is a sectional view showing a state in which the upper portion of the sipping straw is folded down.
Figure 14:
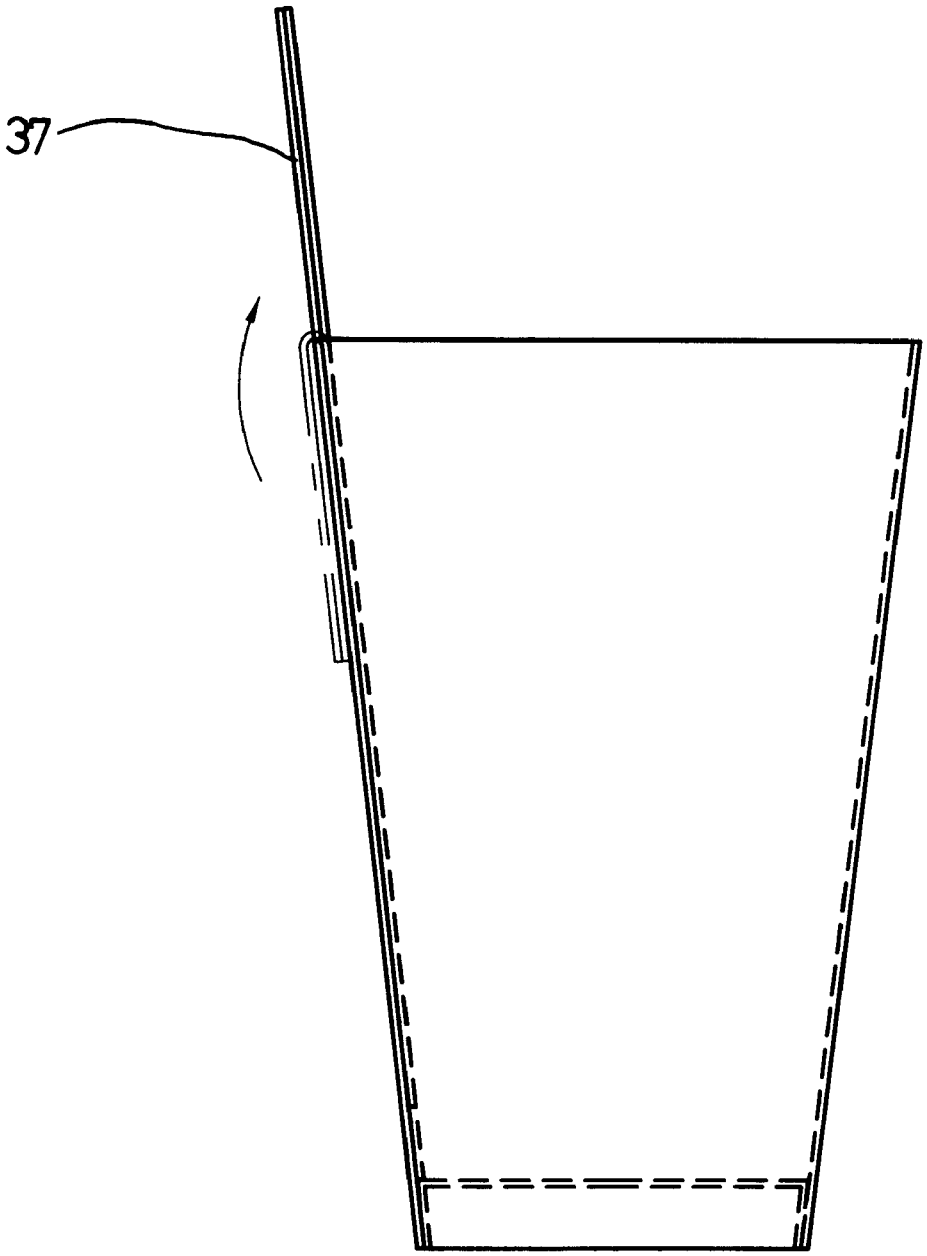
FIG. 14 illustrates a state in which the upper portion of the sipping straw is straightened up.
Figure 15:
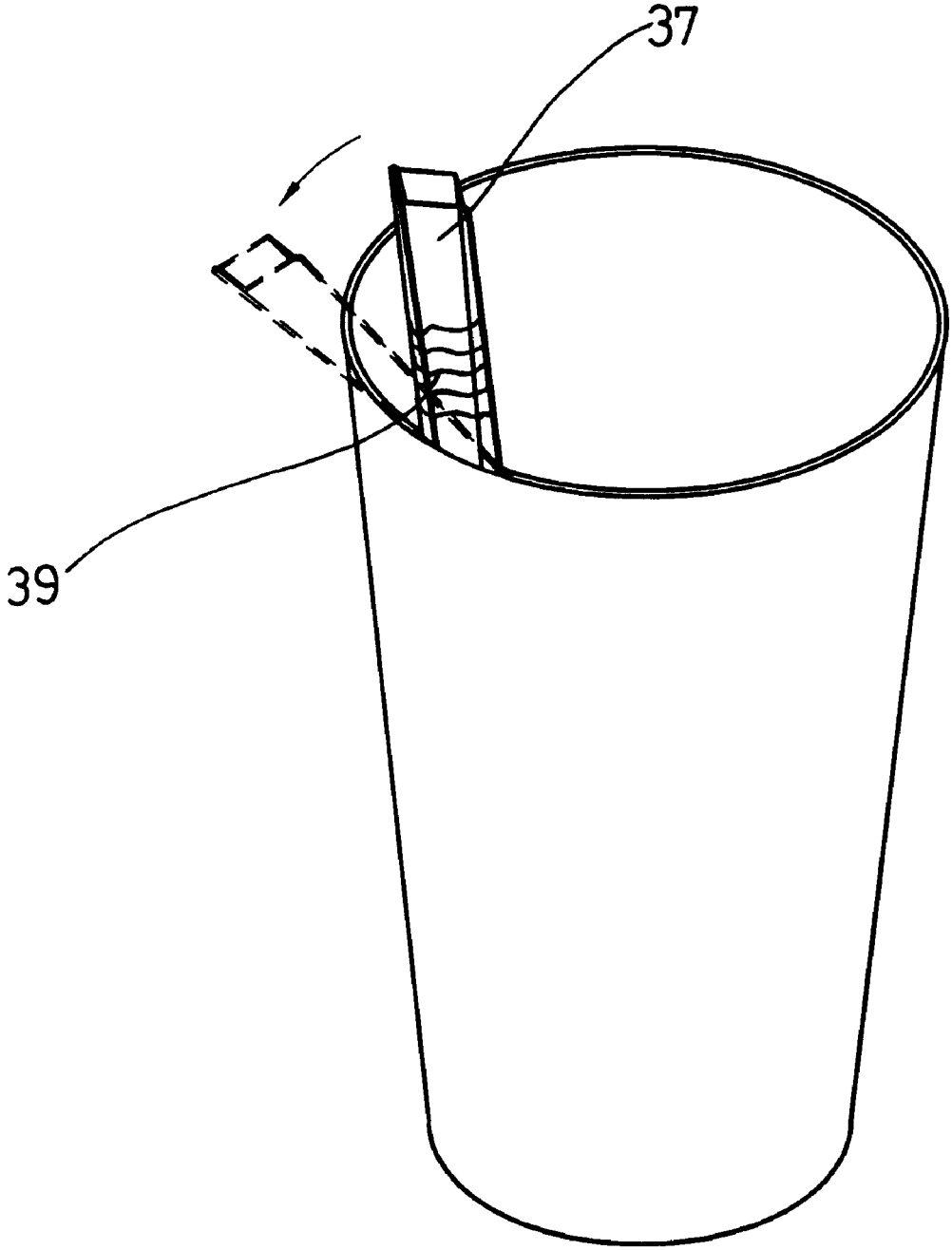
FIG. 15 illustrates a state in which wrinkles are formed on the upper portion of the sipping straw.

FIGS. 13 to 15 illustrate focusingly on an upper portion 37 of the sipping straw.

If the upper portion 37 of the sipping straw remains intact, then there will be accompanied by many difficulties in storing and transporting the paper cups of the present invention. Further, in this case, foreign materials may intrude into the sipping straw.

Therefore, when the paper cup with the sipping straw formed thereon is not used, the upper portion 37 of the sipping straw is folded down to attach it onto the side of the paper cup as shown in FIG. 13. When the sipping straw is to be used, the upper portion which has been folded down is straightened up as shown in FIG. 14.

Meanwhile, wrinkles 39 may be provided on the upper portion 37, so that the sipping straw can be properly bent during the sipping, for the sake of the sipping convenience.

According to the present invention as described above, the sipping straw is coupled to the paper cup during the manufacturing stage, and therefore, the manufacture, procure, transportation and storing can be made through a single route. Consequently, the cost can be saved, while the handling, use and disposition after the use are convenient.

What is claimed is:

1. A paper cup with a sipping straw formed thereon, characterized in that:

a paper stock is sheared to form a paper cup body and a projected portion, said projected portion forming a first portion of said sipping straw;

a separate paper member is attached to said first portion, to make said paper member form a second portion of said sipping straw; and folding lines are formed on an inside of said sipping straw, to make said sipping straw collapsible when not in use, and to make said sipping straw expandable when in use by applying a pressure, whereby the paper cup with the sipping straw formed thereon is manufactured.

2. A paper cup with a sipping straw formed thereon, characterized in that:

a paper stock is sheared to form a paper cup body and a projected portion, said projected portion forming a first portion of said sipping straw;

a separate paper member is attached to said first portion, to make said paper member form a second portion of said sipping straw; and an upper portion of said sipping straw is folded down to make it possible for said sipping straw to be attached to a side of the paper cup when not in use and to be straightened up when in use, whereby the paper cup with the sipping straw formed thereon is manufactured.

3. A paper cup with a sipping straw formed thereon, characterized in that:

a paper stock is sheared to form a paper cup body and a projected portion, said projected portion forming a first portion of said sipping straw;

a separate paper member is attached to said first portion, to make said paper member form a second portion of said sipping straw; and wrinkles are formed on the upper portion of said sipping straw to make it possible to properly bend said sipping straw when in use, whereby the paper cup with the sipping straw formed thereon is manufactured.

4. A paper cup with a sipping straw formed thereon, characterized in that:

an expanded portion is formed on a side edge of a paper cup body;

said expanded portion is rolled into a circular pipe to form a sipping straw; and folding lines are formed on an inside of said sipping straw, to make said sipping straw collapsible when not in use, and to make said sipping straw expandable when in use by applying a pressure, whereby the paper cup with the sipping straw formed thereon is manufactured.

5. A paper cup with a sipping straw formed thereon, characterized in that:

an expanded portion is formed on a side edge of a paper cup body;

said expanded portion is rolled into a circular pipe to form a sipping straw; and wrinkles are formed on the upper portion of said sipping straw to make it possible to properly bend said sipping straw when in use, whereby the paper cup with the sipping straw formed thereon is manufactured.

* * * * *